US008479619B1

(12) United States Patent
Jacovitz

(10) Patent No.: US 8,479,619 B1
(45) Date of Patent: Jul. 9, 2013

(54) JACLOCK SCREW AND JACLOCK SCREWDRIVER

(76) Inventor: Bernard Jacovitz, Delray Beach, FL (US)

( * ) Notice: Subject to any disclaimer, the term of this patent is extended or adjusted under 35 U.S.C. 154(b) by 0 days.

(21) Appl. No.: 13/543,923

(22) Filed: Sep. 7, 2012

(51) Int. Cl.
*B25B 23/00* (2006.01)

(52) U.S. Cl.
USPC ..... 81/460; 411/404; 269/48.3

(58) Field of Classification Search
USPC ..... 81/460, 461, 436; 411/404
See application file for complete search history.

(56) References Cited

U.S. PATENT DOCUMENTS 2,258,326 A * 10/1941 Holt ..... 411/404
3,236,141 A * 2/1966 Smith ..... 269/48.3
3,236,275 A * 2/1966 Smith ..... 81/460

* cited by examiner

*Primary Examiner* — Lee D Wilson

*Assistant Examiner* — Melanie Alexander

(57) ABSTRACT

The invention provides for an improved screw and screwdriver. The self-locking screw and screwdriver, the JacLock™ Screw and JacLock™ Screwdriver, is designed to improve insertion and/or removal of a screw. The new screw head differs from normal horizontal cut/slotted screw heads and cross cut/slotted screw heads. The invention calls for a standard vertical cut/slot in the screw head along with two cross cuts/slots in the head of the screw equi-distant from the center of the horizontal standard slot. The screwdriver has a redesigned head that will fit into the three cuts/slots in the new screw. Once the screwdriver is inserted into the screw head it will lock in place making it easier to insert or remove the screw. The design results in improved torque and eliminates the possibility of the screwdriver slipping off the head of the screw and possibly damaging the head of the screw.

3 Claims, 1 Drawing Sheet

JACLOCK SCREW AND JACLOCK SCREWDRIVER

TECHNICAL FIELD

Certain embodiments of the present disclosure generally relate to the design of a screw and screwdriver and, more particularly in the capability of the screw locking with the screwdriver when the combination is used to insert or remove the screw.

BACKGROUND

Different types of screws and screwdrivers have been developed over centuries. The basic concept is for the screwdriver to be used to insert a complementary screw where the head of the screw mates with the screwdriver allowing for the force of the turning of the screw to be used to either insert the screw or remove the screw. The purpose of the screw is to attach or strengthen parts which typically include metal, wood, plastic, concrete or other composites to something else or to the same composite. While the screw and screwdriver can put things together, often the turning and torque associated with the turning of the screw either for its insertion or removal results in problems to the screw. The screwdriver can slip off the screw during the insertion or removal process damaging the head of the screw. In such cases the screw or bolt must thereafter be drilled in order to ease it out of a hole.

Screws have been developed to allow for better connections with the screwdriver. Improvements to the design of screws has continued but there has not been an effective and cost efficient design of screws that allows for a locking between the screw and screwdriver during the insertion and removal process. The present invention overcomes the present problems providing for a temporary interlocking mechanism between the screw face and the inserting screwdriver design.

SUMMARY OF DISCLOSURE

Certain embodiments provide a simple, inexpensive manufacturing process to make a screw and screwdriver connect and not slip and have a positive easier turning ability while increasing the overall torque during the insertion and removal of the screw.

Certain embodiments of my earlier U.S. Pat. No. 4,539,874 accomplished the locking between the screw and screwdriver during the insertion and removal process but the associated manufacturing process was too expensive. Relying on the original patent, the current embodiments changes the normal horizontal cut in the head of the screw plus, added two vertical cuts in the head of the screw. This revised process allows for all the cuts to the head of the screw to be stamped by a die at one stamping.

BRIEF DESCRIPTION OF THE DRAWINGS

In the drawing:

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

FIG. 1 number 14 illustrates the screwdriver head that will fit into the three cuts that will be made in the screw head

FIG. 2 number 10 illustrates an example of the screw, in accordance with certain embodiments of the present disclosure.

FIG. 2 number 11 illustrates the standard cut in the screw head, in accordance with certain embodiments of the present disclosure.

FIG. 2 numbers 12 & 13 illustrate the two new cross cuts in the screw head, in accordance with certain embodiments of the present disclosure.

DETAILED DESCRIPTION OF THE PREFERRED EMBODIMENT

Figures 1, 2:
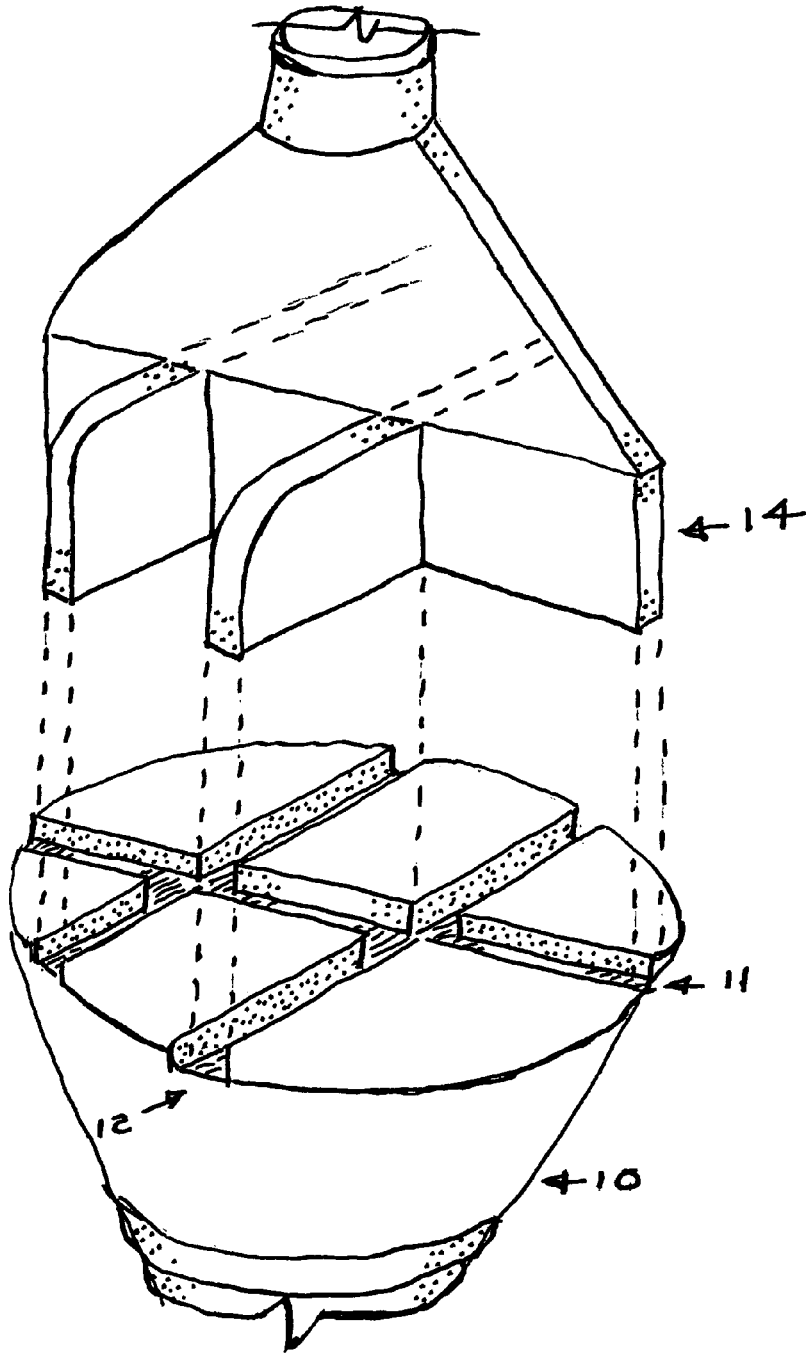
FIG. 1 illustrates an isometric exploded view of the driver head.
FIG. 2 is an isometric mated view of the driver head shown in FIG. 1 as it is to be inserted into the screw head.

Referring to the drawings, FIGS. 1 and 2 illustrating one embodiment of the invention, the driver 10 in FIG. 1 and fastener FIG. 2 numbers 11, 12, 13 are to be mated together. The three blades that represent number 14 on FIG. 1 are designed to temporarily interlock with the slots numbered 11, 12 and 13 on FIG. 2. Upon temporary interlocking the driver can be turned for tightening or untightening the respective fastener.

In FIGS. 1 and 2 the driver head number 14 of FIG. 1 and fastener number 10 in FIG. 2 numbers 11, 12, and 13 mate with one another and have respective configurations that can temporarily interlock to allow the fastener to be moved to a work location or to be driven into or removed from the work place. The temporary interlock occurs when the blade FIG. 1. which includes three separate planes two parallel to one another and the third perpendicular to the other two mates with the corresponding slots numbers 11, 12, 13 on FIG. 2. The interlocking of the screwdriver and fastener allows for increasing torque to be applied that turns the fastener for insertion or removal without the ability of the blade slipping out of or off of the face of the fastener FIG. 2 The temporary interlock allows for maximum turning force to be applied to the driver without applying an additional downward pressure force to hold the fastener and driver together.

What is claimed is:

1. A combination of a fastener and a tool driver comprising:

the tool driver comprising a body;

a handle connected at one end of said body;

an elongated shaft extending along a longitudinal center line;

a blade means located at another end of said body and extending from an end of said elongated shaft;

said blade means comprising a plate plane containing the longitudinal center line and two latitudinal plates extending from said longitudinal center line plate plane spaced equally apart from the center of the longitudinal center line;

said longitudinal center line extending from outer sides of said two latitudinal plates, thereby forming an H shape with lateral extensions; and said fastener including a head with a base portion with an elongate shaft extending generally along said longitudinal center line and two corresponding latitudinal cuts spaced equally apart from the longitudinal center line cut wherein all said cuts extending there through forming three slot means.

2. The tool according to claim 1, wherein said two latitudinal plates have a flat bottom and are arcuate shape.

3. A tool driver for removing a fastener comprising:

the tool driver comprising a body;

a handle connected at one end of said body;

an elongated shaft extending along a longitudinal center line;

a blade means located at another end of said body and extending from an end of said elongated shaft;

said blade means comprising a plate plane containing the longitudinal center line and two latitudinal plates extending from said longitudinal center line plate plane spaced equally apart from the center of the longitudinal center line; and said longitudinal center line extending from outer sides of said two latitudinal plates, thereby forming a H shape with lateral extensions.

* * * * *